US012692446B2

(12) United States Patent
Zhao et al.

(10) Patent No.: US 12,692,446 B2
(45) Date of Patent: Jul. 28, 2026

(54) HYBRID FURNACE WITH FUEL AND/OR ELECTRICITY

(71) Applicant: LUMMUS TECHNOLOGY LLC, Houston, TX (US)

(72) Inventors: Baozhong Zhao, Houston, TX (US); Eduardo Hart, Houston, TX (US); Stephen Stanley, Houston, TX (US); Kandasamy Sundaram, Houston, TX (US); Aijing Yin, Houston, TX (US); Xueping Li, Houston, TX (US)

(73) Assignee: Lummus Technology LLC, Houston, TX (US)

( * ) Notice: Subject to any disclaimer, the term of this patent is extended or adjusted under 35 U.S.C. 154(b) by 193 days.

(21) Appl. No.: 18/643,263

(22) Filed: Apr. 23, 2024

(65) Prior Publication Data

US 2024/0352338 A1 Oct. 24, 2024

Related U.S. Application Data

(60) Provisional application No. 63/497,775, filed on Apr. 24, 2023.

(51) Int. Cl.
*C10G 9/24* (2006.01)

(52) U.S. Cl.
CPC ..... *C10G 9/24* (2013.01)

(58) Field of Classification Search
CPC ..... C10G 9/24; C10G 9/20
See application file for complete search history.

(56) References Cited

U.S. PATENT DOCUMENTS

2022/0395805 A1 12/2022 Mortensen
2023/0013408 A1 * 1/2023 Hirst ..... C10G 9/36

FOREIGN PATENT DOCUMENTS

CN 113531546 A 10/2021
EP 4056892 A1 * 9/2022 ..... F22B 1/18
KR 2023-0008046 A 1/2023
WO 2020-150244 A1 7/2020

OTHER PUBLICATIONS

International Search Report issued in International Application No. PCT/US2024/025868 dated Aug. 16, 2024 (4 pages).
Written Opinion issued in International Application No. PCT/US2024/025868 dated Aug. 16, 2024 (5 pages).

* cited by examiner

*Primary Examiner* — Randy Boyer
*Assistant Examiner* — Juan C Valencia
(74) *Attorney, Agent, or Firm* — Osha Bergman Watanabe & Burton LLP

(57) ABSTRACT

An apparatus including a radiant heating section and a flue gas stack; one or more process coils disposed within the radiant heating section; one or more fuel-fired burners disposed within the radiant heating section, the one or more fuel-fired burners configured for combusting a fuel and producing the combustion gas; one or more electrical heating elements disposed within the radiant heating section, the one or more electrical heating elements arranged to provide a second radiant energy to a lower elevation of the one or more process coils; and an internal baffle located at an elevation between the upper elevation and the lower elevation, the internal baffle arranged to provide shielding of the one or more electrical heating elements from flame and combustion gases from the one or more fuel-fired burners.

18 Claims, 8 Drawing Sheets

HYBRID FURNACE WITH FUEL AND/OR ELECTRICITY

BACKGROUND

In the refining and petrochemical industries, heaters are predominantly fuel fired. The current fired heaters generate carbon dioxide when firing hydrocarbon fuels, which is a source of greenhouse gases that lead to global warming. Thus, there is a general desire to move away from hydrocarbon fuel-fired heaters.

Electric heaters, however, are presently limited to relatively small capacity, and only now under development for large capacity application. However, none of the heaters are designed to have co-existence of fuel fired burners and electric heating elements, a hybrid energy input with both fuel combustion and electricity. When the electric heating elements and fuel burners are both installed in a heater, the intensive combustion from the burners tends to damage the electrical heating elements due to overheating or carburization.

Several challenges exist when shifting to solely electrical heating. Further, the electric heaters do not directly combust any fuels and will not have any flue gas. The electric heater will not have convection sections, which are traditionally used to capture additional heat for steam generation and feed pre-heating, among other uses. When the electric power is lost, the electric heater will have to be shut down and the plant operation will be interrupted, or equipment damaged, due to sudden operating condition changes.

Accordingly, there exists a need in the art for heaters that provide operational continuity while also reducing greenhouse gas production.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to an apparatus for heating petroleum, petrochemical, chemical process fluids, and boiler feed water or steam generation with a combination, or individual operation, of electrical elements and fired burner. The apparatus further includes a radiant heating section and a flue gas stack for exhausting a combustion gas to the atmosphere; one or more process coils disposed within the radiant heating section; one or more fuel-fired burners disposed within the radiant heating section, the one or more fuel-fired burners configured for combusting a fuel and producing the combustion gas, wherein the one or more fuel-fired burners are arranged to provide a first radiant energy to an upper elevation of the one or more process coils; one or more electrical heating elements disposed within the radiant heating section, the one or more electrical heating elements arranged to provide a second radiant energy to a lower elevation of the one or more process coils; and an internal baffle located at an elevation between the upper elevation and the lower elevation, the internal baffle arranged to provide shielding of the one or more electrical heating elements from flame and combustion gases from the one or more fuel-fired burners. The one or more electrical heating elements are configured to provide 5% or more of a combined maximum energy output of the one or more fuel-fired burners and the one or more electrical heating elements.

In other aspects, embodiments disclosed herein relate to a process for retrofitting a fuel-fired heater, having a radiant heating section, one or more process coils in the radiant heating section, and a flue gas stack, for heating petroleum, petrochemical, chemical process fluids, and boiler feed water or steam generation to include a combination of electrical heating elements and fuel-fired burners. The process includes removing one or more fuel-fired burners disposed at a lower elevation in the radiant heating section; retaining one or more fuel-fired burners disposed at an upper elevation in the radiant heating section; disposing one or more layers of refractory material in the lower elevation in the radiant heating section; disposing one or more electrical heating elements in the lower elevation in the radiant heating section proximate a surface of the one or more layers of refractory material, wherein the one or more electrical heating elements are disposed at a distance of 12 to 18 inches from the one or more process coils; and disposing an internal baffle between the upper elevation and the lower elevation, the internal baffle configured to provide shielding of the one or more electrical heating elements from flame and combustion gases from the one or more fuel-fired burners.

In yet another aspect, embodiment disclosed herein relate to a method of retrofitting a cracking heater comprising a radiant heating zone and a convective heating zone, wherein the radiant heating zone comprises a floor, floor burners disposed in the floor, a refractory wall including a first wall opposite a second wall, wall burners disposed along a height of the first wall and the second wall, and a radiant coil disposed within the radiant heating zone intermediate the first wall and the second wall. The method includes installing an intermediate floor at an elevation below a wall burner; installing a second refractory wall from the floor to the intermediate floor; moving a floor burner from the floor to the intermediate floor; and installing one or more electrical heating elements along a height of the second refractory wall.

Other aspects and advantages of the claimed subject matter will be apparent from the following description and the appended claims.

DETAILED DESCRIPTION

Figure 1B:
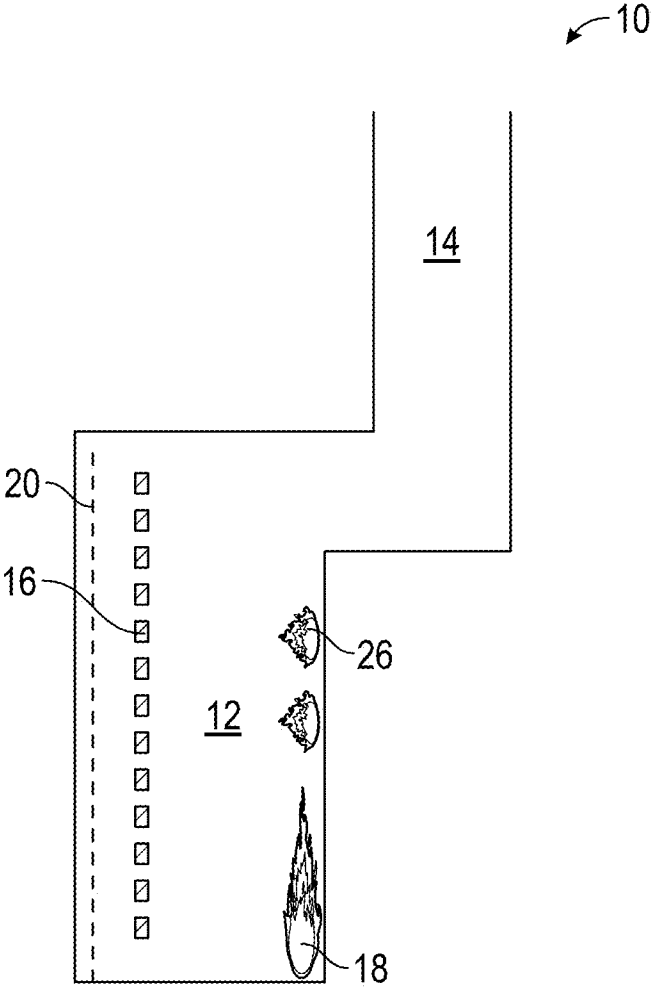
FIGS. 1A and 1B illustrate various hybrid heater designs according to embodiments herein.

In one aspect, embodiments disclosed herein relate to heaters providing a combination of both fuel-fired burners and electrical heating elements. Embodiments herein will have a fuel-fired burner and electrical heating elements in the same chamber and the heater can be operated with the fuel burner, heating elements, or both at the same time.

A heater for heating petroleum, petrochemical, chemical process fluids, and boiler feed water or steam generation/superheat with a combination, or individual operation, of electrical heating elements and fuel-fired burners according to some embodiments herein include a radiant heating section, a convective heating section, and a flue gas stack. The radiant section includes one or more fuel-fired burners, such as including one or both of wall and floor burners, and one or more electrical heating elements, which can be metallic, non-metallic or a combination of metallic and non-metallic, where each of the burners and electric heating elements are arranged and configured to provide radiant heat to one or more process or utility streams (heating coils, radiant coils, or process coils herein) disposed within the radiant section of the heater. The convective section of the heater is configured to receive a combustion gas produced by the fuel-fired burners and, in some embodiments, is further configured to provide convective heat to one or more process or utility streams (convective coils) disposed and arranged within the convective section of the heater. The flue gas stack is configured similar to typical furnaces and receives the (heat-depleted) combustion gas from the convective heating section and for exhausting the combustion gas to the atmosphere.

In some embodiments, the one or more fuel-fired burners are arranged to provide radiant energy to a first portion or first area of the one or more process coils. Further, the one or more electrical heating elements disposed within the radiant heating section are arranged to provide radiant energy to a second portion or second area of the one or more process coils. For example, in various embodiments the fuel fired burners and electrical heating elements may be arranged to provide heat to different coils, may be arranged vertically within the heater to provide radiant heat to different elevations of the same or different coils, or may be arranged horizontally within the heater to provide radiant heat to different coils or different portions of a coil.

Heating at different elevations may be provided, for example, by disposing electrical heating elements at a lower elevation within the heater and disposing fuel-fired burners vertically above the electrical heating elements. In this manner, the combustion products, which preferentially exhaust upward, may not result in soot or deposition of combustion products on the electrical heating elements.

In other embodiments, the one or more fuel-fired burners are arranged to provide radiant energy to a first elevation of the one or more process coils. Further, the one or more electrical heating elements disposed within the radiant heating section are arranged to provide radiant energy to a second elevation of the one or more process coils. For example, a process coil may be disposed intermediate (between) both one or more fuel-fired burner and one or more electrical heating elements. Radiant energy from the fuel-fired burners may thus impact and heat the first elevation of the process coils, while radiant energy from the electrical heating elements may impact and heat the second elevation of the process coils.

Embodiments herein are thus configured and arranged to provide radiant energy to process coils via radiant energy from fuel-fired burners, electrical heating elements, or both burners and heating elements. Such configurations will allow the heater to be operated with fuel firing, or partial fuel firing supplemented by electric heating, or completely with electric heating. The greenhouse gas emission can be reduced and the waste heat from combustion exhaust can be recovered by feedstock preheat of auxiliary streams via the convection section. In embodiments where carbon-free fuels like H2 or NH3 are used, there will not be any greenhouse gas emissions from the flue gas stack. More importantly, the heater and associated equipment can stay in operation in the event of a power failure, by operating the fuel-fire burners, or fuel supply shortage, by operating the electrical heating elements.

As outlined above, embodiments herein may include providing radiant energy directly from an electrical heating element to a process coil. Proper design of a heater may limit or prevent undesired overheating or carburization of the electrical heating elements. Exposure of the electrical heating elements to radiant energy from the burners, as well as exposure of the electrical heating elements to combustion products, may be limited, for example, by design considerations such as: vertical arrangement of heating elements and burners; partial or total shielding of the electrical heating elements via shield walls, shield tiles, or shield tubes; or various combinations of two or more of these design considerations.

In some embodiments, the heater may not be equipped with a convection section and may just exhaust combustion gas directly through the flue gas stack. In other embodiments, the hot flue gas may be routed to other heat recovery units such as external gas-fluid heat exchangers or waste heat boilers.

For example, in some embodiments, the electrical heating elements are shielded by a high temperature material where the combustion of fuel and the exhaust gas will not be in direct contact with the electrical heating elements. As another example, the electrical heating elements may be configured to provide varying amounts of heating from one element, or group of elements, to another. In such examples, the heat profile of the electrical heating elements may be non-uniform across either or both the width or height of the furnace at the elevations where the electrical heating elements are disposed. The electrical heating elements may provide uniform heat flux or may be arranged to provide heat in a selected heat flux pattern to meet process requirements. The heating elements, both fuel fired and electrical, are disposed throughout areas (floor, lower wall, or upper wall, for example) in a heater that may have the same or different mechanical configurations. The heating elements may be installed evenly or in a selected pattern throughout the heater. Embodiments herein may thus provide unique and advantageous arrangements of the fuel-fired burners and electrical heating elements, providing for excellent flexibility in operation of heating by electrical energy, combustion, or both.

In some embodiments, the electrical heating elements may be useful for retrofit of an existing heater to convert from 100% fuel fired to at least partially electrically heated. This can be accomplished by installing an electric heating section below the combustion section and may result in improved heat flux distribution, increased coil life, and improved overall performance.

Referring now to the Figures, exemplary embodiments of various configurations of hybrid heaters, including electrical heating elements and fuel-fired burners, are illustrated. In the Figures, like numerals represent like parts.

Figure 1A:
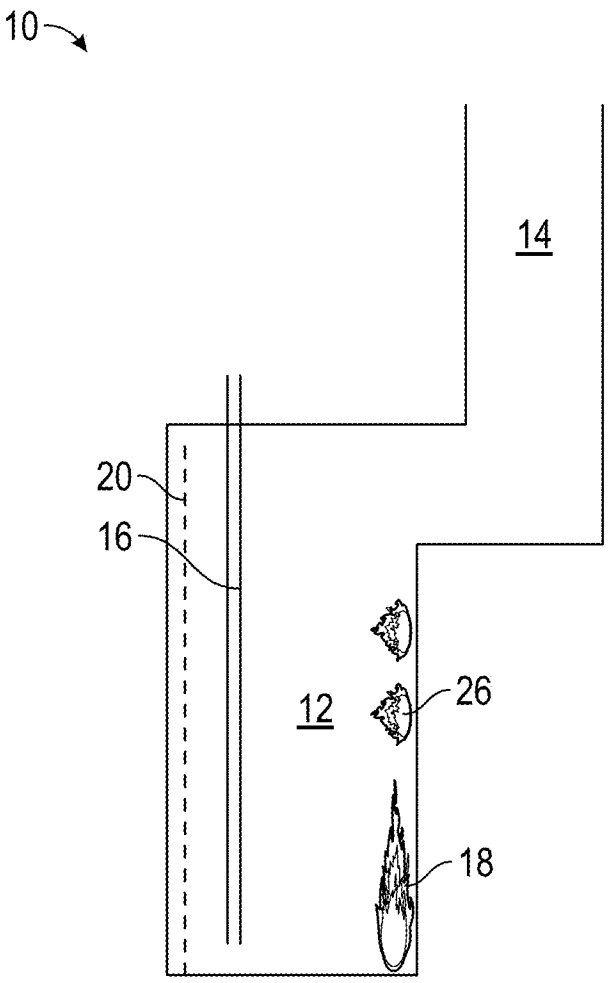

FIGS. 1A (vertically oriented process coils), 1B (horizontally oriented process coils), 2A, and 2B illustrate designs of a hybrid heater 10 according to embodiments herein. In these embodiments, heater 10 includes a radiant section 12, a convection section 14, and a flue gas stack (not illustrated). Within radiant section 12, process coils 16 are disposed intermediate (between) a combustion heat source, including floor burners 18 and wall burners 26, and an electrical heat source, including electrical heating elements 20. The process coil is kept at clearance to (a distance from) the refractory wall of the fire box (radiant section 12). Electric heating elements 20 are installed next to, or on, the refractory wall. The fuel-fired burners 18, 26 may include multiple burners, such as 1, 2, 3, 4, or more, such as up to 10, 12, or 16 burners, installed in the upper elevation of the fire box. The process coils 16 separate the electric heating elements 20 from the burners 18.

In a typical fuel-fired only heater, the process coils are next to the internal insulating material. The combustion energy is transferred to the process coil and the refractory material behind the coil by direct radiation. The energy received by the refractory material is then re-radiated to the side of the coil opposite the burner. The heat transfer intensity by re-radiation is less than the direct radiation from the flame. The front side (flame side) of the coil may thus reach a maximum acceptable tube metal temperature or process fluid film temperature, while the back side is at a much lower temperature.

In contrast, embodiments of FIGS. 1A and 1B may provide radiant energy from the electric heating elements to balance the heat input to the process coils, so that both the front side and back side can be under close process and mechanical conditions. In other words, the electrical heating elements may provide sufficient energy such that the front and back sides of the process coils may have similar temperatures and the average heat flux to the coil can be increased. This means, for a given duty to the process, the max tube metal temperature will be reduced, and if the heater is operated near the max tube metal temperature, the heat pickup by the coil can be increased. Further, for the same process duty, less heating surface will be needed because of the optimized heat distribution to the coil. With reduced heating surface area requirements, it may also reduce the process side pressure drop, i.e., the heater may allow a higher capacity compared to a typical heater.

Figure 2B:
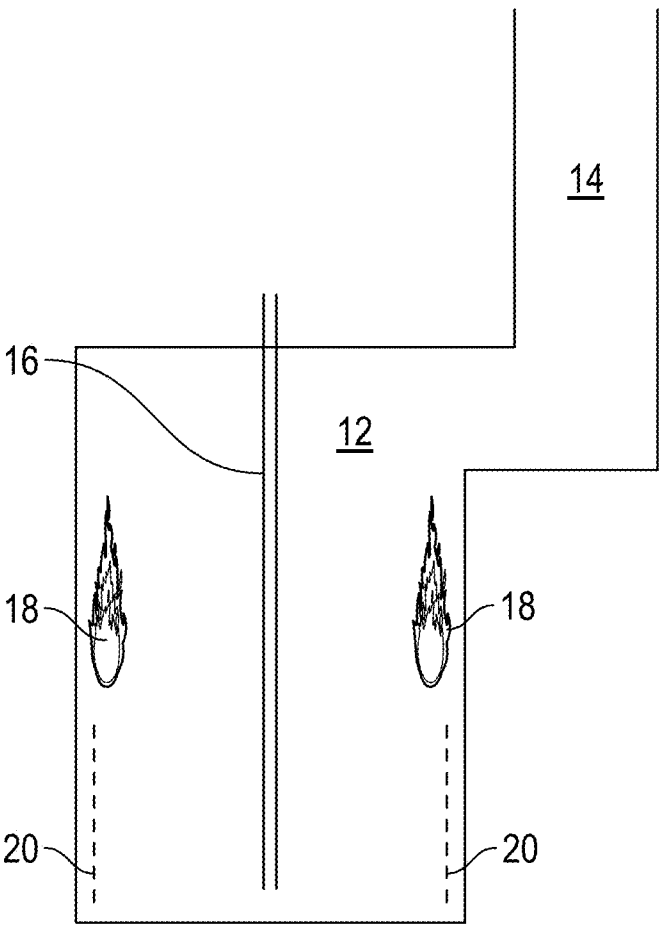
FIGS. 2A and 2B illustrate various hybrid heater designs according to embodiments herein.
Figure 2A:
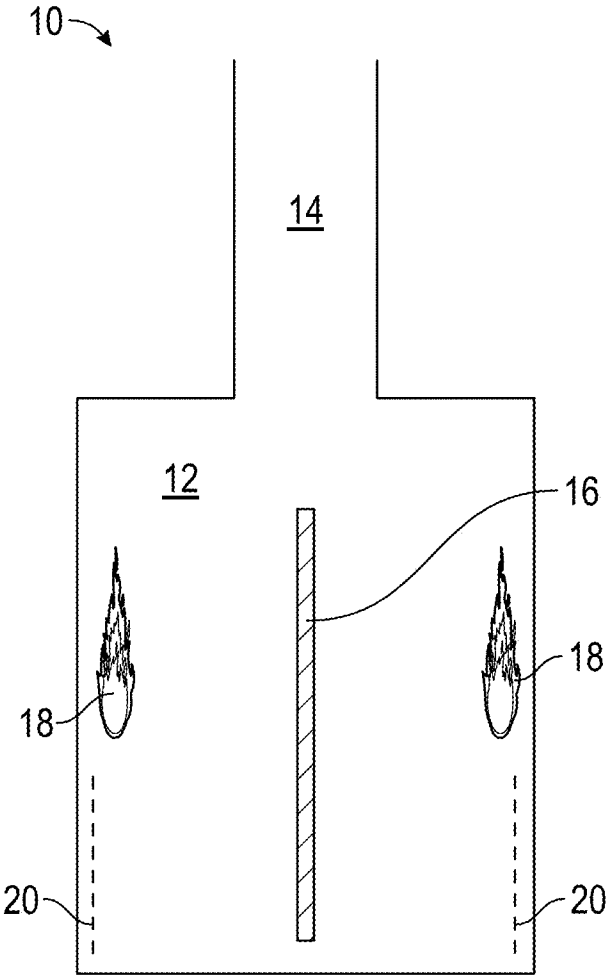

FIGS. 2A and 2B are double fired hybrid designs. In these embodiments, heat input is provided with hybrid heating from both sides (both electrical and fired heating on both sides of a coil). The one or more burners 18 are installed at a higher elevation and the one or more electrical heating elements 20 at a lower elevation to minimize the possibility of flame impingement to the one or more electrical heating elements 20. The one or more burners 18 are arranged on both sides of the process coil 16, as are the one or more electric heating elements 20. While illustrated with the burners 18 and heating elements 20 a similar distance from the process coil 16, embodiments herein may have the casing associated with the electrical heating elements closer to the process coils than the burners.

With respect to the embodiments of the hybrid heating designs as illustrated in FIGS. 1A, 1B, 2A, and 2B, it is noted that heat flux from the burners, as well as possible impingement of hot flue gas and soot on the electrical heating elements may result. In some embodiments, the electrical heating elements may be limited to SiC, which is more tolerant to higher temperature operation and the combustion gas environment and may thus avoid premature electrical heating element failure. In other embodiments, such as those having less tolerant electrical heating elements, a small flow of a gas or recirculated exhaust gas into the electrical heating section may be used to promote upward flow of exhaust so as to avoid soot or combustion gas impingements, maintaining an environment favorable to the electrical heating element operation.

Other embodiments may be designed to minimize the effects of the combustion zone on the electrical heating elements. As illustrated in FIG. 3A, to protect the electrical heating elements from the flame or heat impingement and the environment within the radiant section, the bottom section of the radiant section 12 is designed to have electrical heating elements 20 at a lower elevation, and not in vertical alignment with the fuel fired burners 18. The fuel fired burners 18 are installed at a higher elevation. The electrical heating and the fuel firing will thus be in two separate sections. The combustion flue gas will not flow through or over the electrical heating elements, which avoids any possibility of flame impingement and minimize the oxidation of the heating element by the flue gas.

Figure 3B:
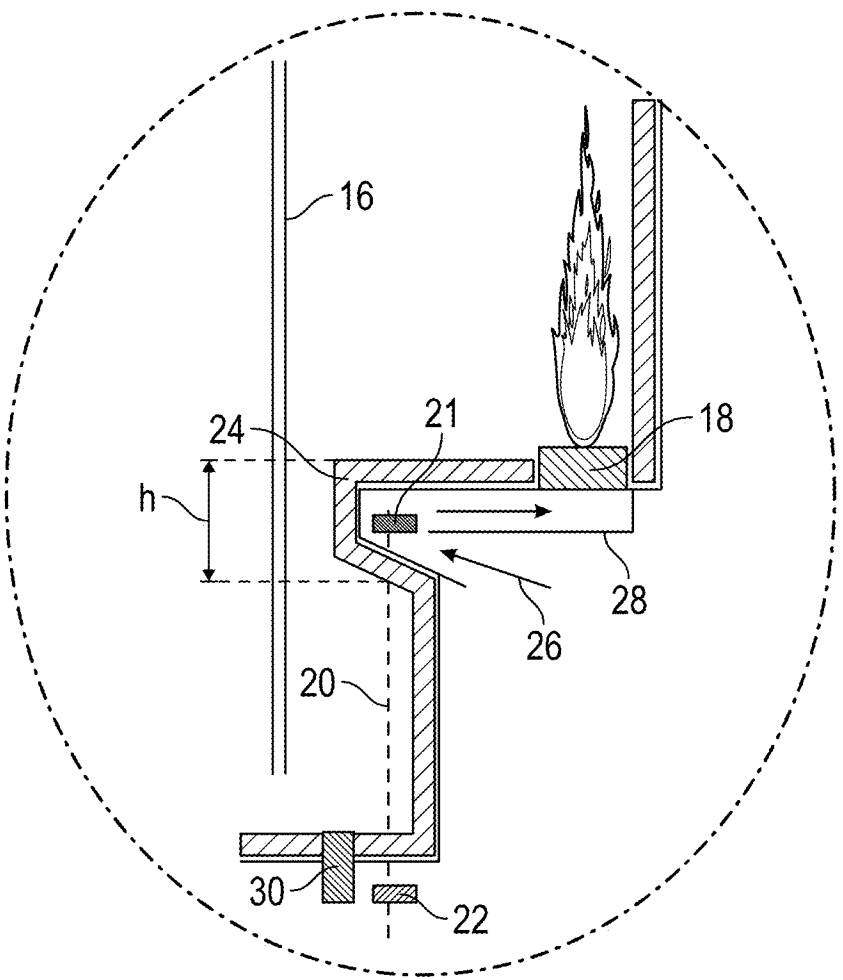
FIGS. 3A and 3B illustrate various hybrid heater designs according to embodiments herein.
Figure 3A:
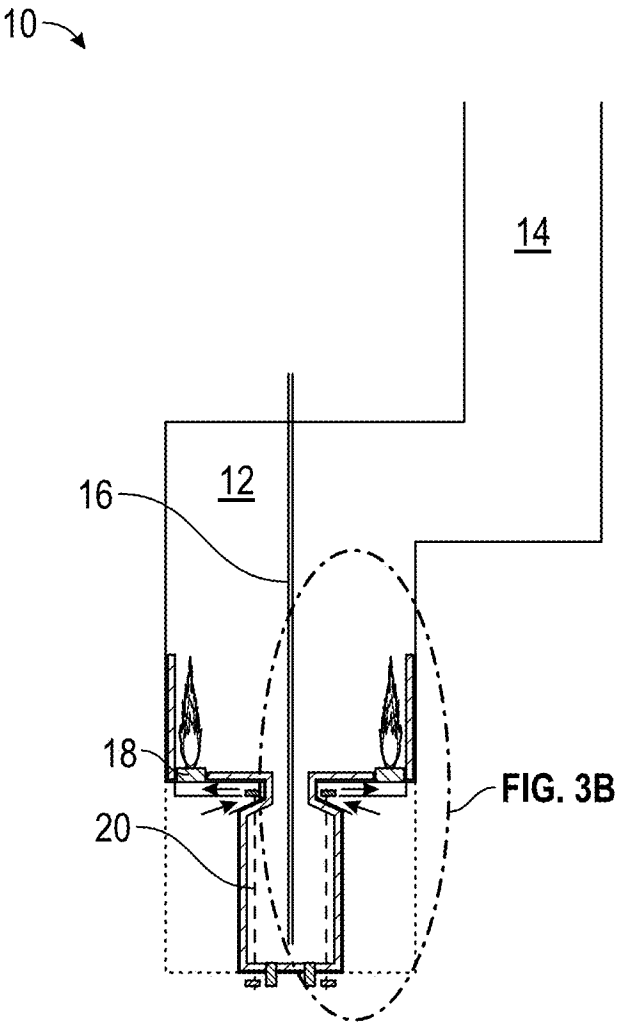

The general configuration illustrated in FIG. 3A is enlarged to show detail in FIG. 3B. Such configuration allows the electrical heating elements to be at the desired distance from the process coils 16 for even and effective heat transfer. Depending upon the process condition and the mechanical limitations the distance from the heating elements to the heat receiving surface (radiant coil) may be in a range from about 12-18 inches (300-460 mm), which provides more even heat flux distribution and allows room for maintenance.

The electrical heating element 20 can include a first power connection 21 and a second power connection 22. The second power connection 22 is installed outside the heater 10 and is cooled by ambient air. The first power connection 21 may also be installed outside the heater 10, but may be located in a recessed cavity created by a bull nose, or internal baffle 24. Being located in such an area may limit the ability for ambient air to properly cool the first power connection 21. However, in some embodiments, the fuel fired burner 18 may introduce combustion air 26 through a channel created by external baffle 28. The combustion air will travel over the first power connection 21 providing adequate cooling. At the same time, the heat removed from the first connection point 21 by the combustion air 26 will pre-heat the combustion air utilized for combustion in fuel fired burner 18 to improve the overall fuel efficiency.

The internal baffle 24 may define an opening between the lower electrical heating zone and the upper fuel fired zone to equalize the pressure between the lower electrical heating zone and the upper fuel fired zone. While not illustrated, the opening may also be closed to minimize the combustion flue gas entering the electrical heating section, with provision of pressure relief in case any potential pressure buildup in the electrical heating section.

In some embodiments, one or more purge connections 30 are provided in the radiant section 12. The purge connection can be used to set an environment within the heater prior to the heater startup or can be used to remove any hazardous gas from the heater during shut down. When necessary, a purge gas may be provided through the purge connection to maintain the radiant section with a required working environment, such as to prevent moisture from accumulating in the electrical heating zone, such as due to combustion in the upper zone, which may cause damage to the heating elements. The purge can be continuously or intermittently operated as needed. In some embodiments, one or more sensors may be located with or proximate the purge connection to monitor temperature, pressure, humidity, flow rate, etc. The purge gas can be air, nitrogen, or other types of gas which may be required to meet the requirements of the selected heating elements. In some embodiments, a small amount of oxygen may be introduced with non-air purge gases to ensure that the heating elements maintain an oxide layer or are not exposed to a reducing atmosphere.

Figure 4B:
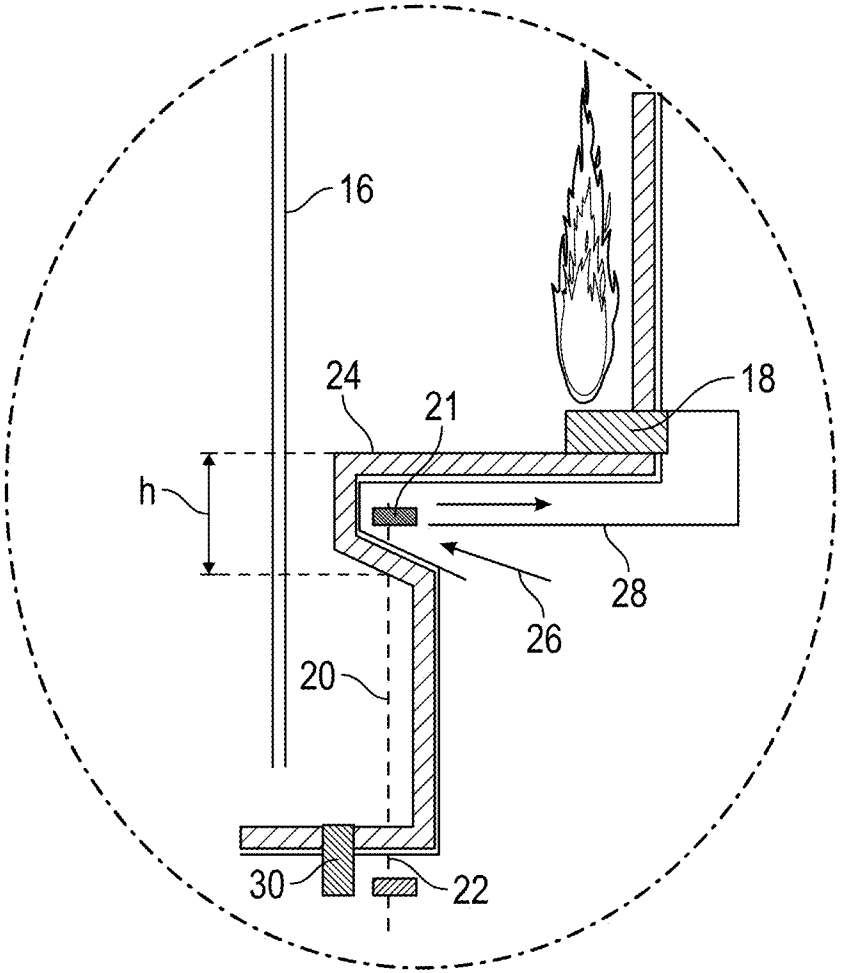
FIGS. 4A and 4B illustrate various hybrid heater designs according to embodiments herein.
Figure 4A:
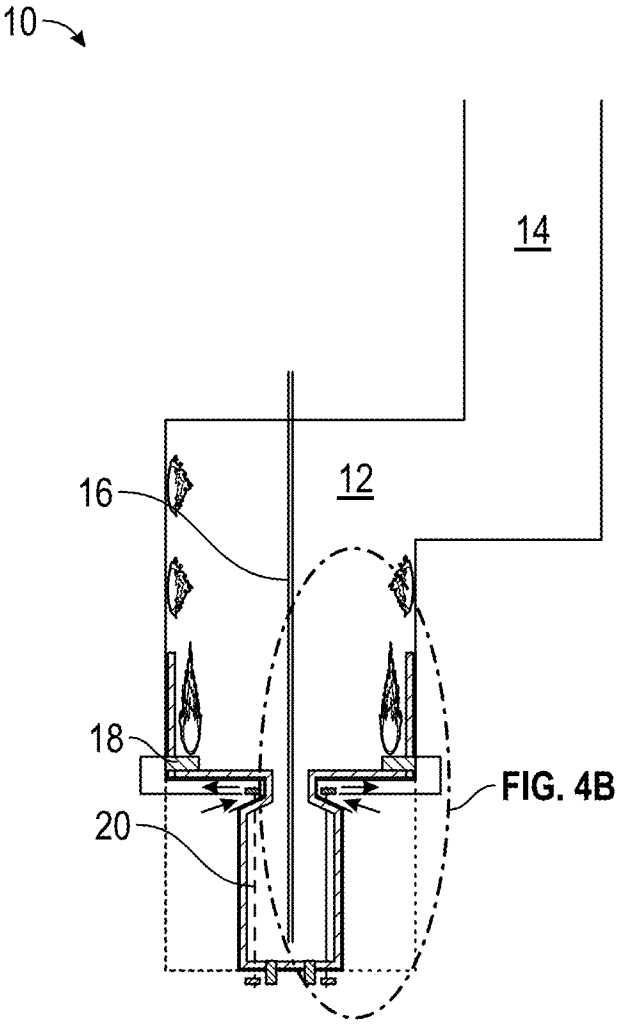

For the upper fuel fired section, the fuel fired burners 18 can be installed through the floor of the fired section as hearth burners (FIG. 3B). The fuel fired burners can also be installed as side burners and floor burners (FIG. 4A). The floor firing burner can also be through the side wall as side entry burner, i.e., balcony burners (FIG. 4B). The fuel firing can be floor fired or wall fired or combination with both the floor and wall fired.

Retrofitting of an existing heater to arrive at the embodiments of FIGS. 3A, 3B, 4A, and 4B may be accomplished by raising a floor associated with the hearth burners and moving the wall associated with the electrical heating elements installed. Such may also result in the bull nose configuration as illustrated. Additionally, one or more layers of refractory material may be added below the new height of the hearth burners to define the wall associated with the electrical heating elements. In some embodiments, the hearth burners and one or more wall burners may be removed from the bottom of the existing heater, leaving one or more wall burners. The one or more layers of refractory material may then be added in the lower portion of the heater to define the new wall associated with the electrical heating. Once the new wall is defined, the one or more electrical heating elements may be installed in any configured disclosed herein, or in any other configuration as deemed appropriate for the heater being retrofitted.

In other embodiments, a shielding baffle or refractory may be installed to retrofit an existing heater to provide for the hybrid heating. This may be accomplished by installing layers of refractory material in the lower portion of the heater as illustrated in FIG. 5A. As illustrated, the heating elements 20 will be installed at a distance from the radiant coil 16. The area between the electrical heating elements 20 and the exterior wall of the heater is then layered with one or more layers of refractory material 40. The layers of refractory material 40 may be the same or different from layer to layer. The refractory thickness of the bottom section may be different than the refractory thickness of the upper section to allow the best refractory re-radiation to the coil, minimize the amount of flue gas around the electrical heating elements, and reduce the purge gas consumption to maintain a preferred working environment. A shielding refractory 42 may be installed to separate the lower electrical and upper fuel firing zone. The shield refractory 42 may leave an opening between the electrical and the fuel fired sections in some embodiments, or fully separate the electrical and the fuel fired sections without opening in other embodiments. As with the internal baffle (FIG. 3B), the shielding refractory 42 protects the electrical heating elements from heat or flame impingement, allowing for different types of electrical heating elements to be used. The fuel fired burners may be side entry burners with or without addition of the wall burners.

Figure 5B:
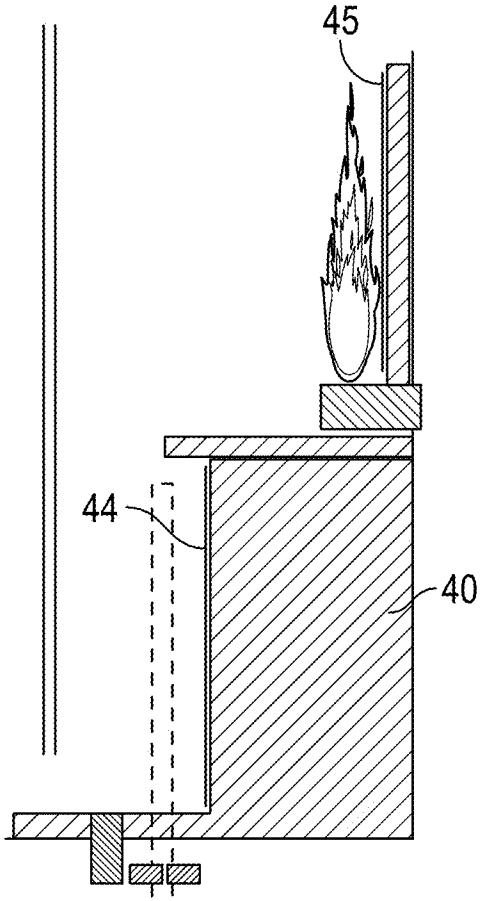
FIGS. 5A and 5B illustrate various hybrid heater designs according to embodiments herein.
Figure 5A:
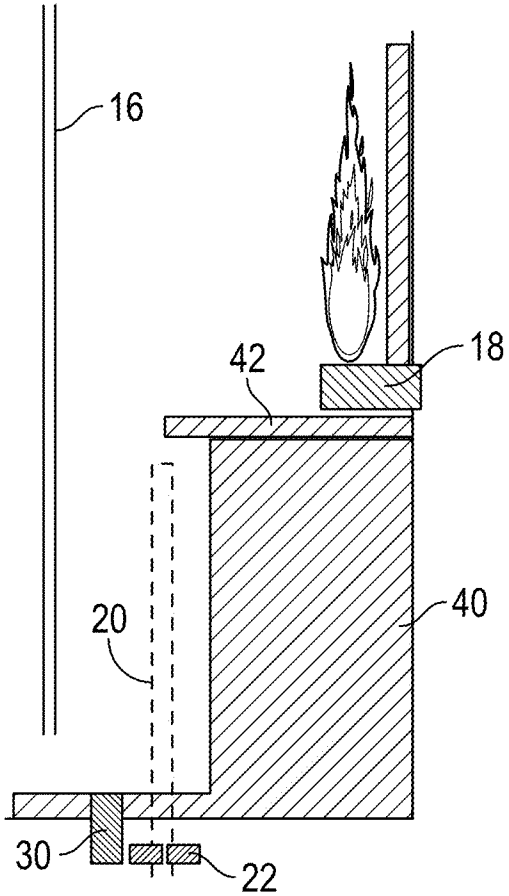

Further, as illustrated in FIG. 5B, the refractory material 40 may have a refractory coating 44 or a layer of high temperature material with high emissivity over the refractory hot face. The refractory coating 44 may improve the radiant heat transfer to the heat receiving surface of the process coils and, at the same time, lower the working temperature of the heating elements and refractory for a given heat duty. The refractory coating 44 or high temperature material with high emissivity may cover the entire electrical heating section or part of the section, as needed. The upper, fuel fired section may also have a refractory coating 45. The refractory coating 45 may be the same or different than refractory coating 44, but otherwise serves the same purpose.

Figure 6A:
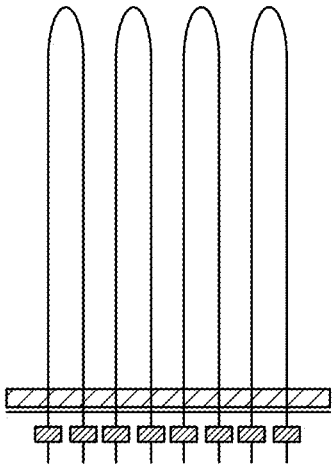
FIGS. 6A to 6E illustrate various heating element designs according to embodiments herein.
Figure 6B:
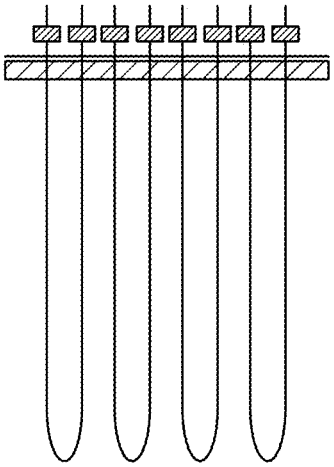
Figure 6C:
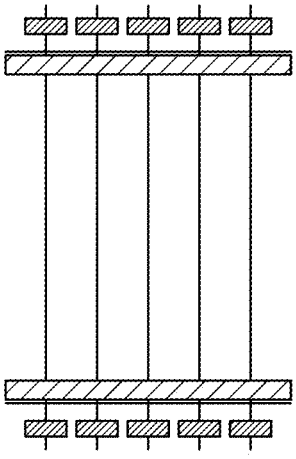
Figure 6D:
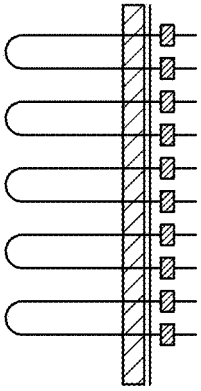
Figure 6E:
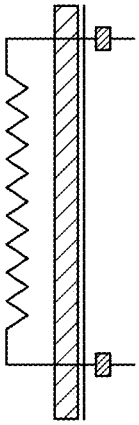

FIGS. 6A-6E illustrate configurations the electrical heating elements may take in one or more embodiments. The heating elements can be either metallic or non-metallic, in a configuration of arbor style (FIG. 6A), U-type (FIG. 6B), stick/rod (FIG. 6C), horizontal (FIG. 6D), accordion style (FIG. 6E), or any combinations of 6A through 6E. FIGS. 6A, 6B, and 6C are for vertical installation and FIGS. 6D and 6E show horizontal installation. Other element types that can be used are bayonet type (with both electrical terminals at the same end). Further, the electrical heating elements are not limited to the layout as shown in FIGS. 6A-6E. For instance, the heating elements shown in FIG. 6C can be installed in horizontal position. The particular arrangement used may also depend upon the material of the heating element itself and associated mechanical restrictions at operating temperatures.

The electrical heating elements can be completely with metallic heating elements or non-metallic heating elements or combination of metallic and non-metallic, in any form, style or material. Non-metallic SiC elements or MoSi2 elements offer high heat flux at temperatures>1000 C. However, with the placement of the electrical heating elements as described in FIGS. 3A to 5B, such high heat flux temperature material may not be required.

In some embodiments, the process conditions in hybrid heaters are kept unchanged, including the steam production, while the fuel firing can be reduced by about 15%, i.e., 15% CO2 reduction, up to about 35% reduction. By adjusting the excess air to the burners only a small reduction in SHP steam production can be expected. With higher excess air, higher steam production is possible, but that will increase fuel consumption and reduce the % CO2 reduction.

With hybrid heating, the heat flux in the radiant section will be improved due to even heat output by the electrical heating element over the surface area of the process coils. The hybrid heating can improve the heat flux and reduce the maximum tube metal temperature which may improve the heater run length or the coil service life.

Figure 7:
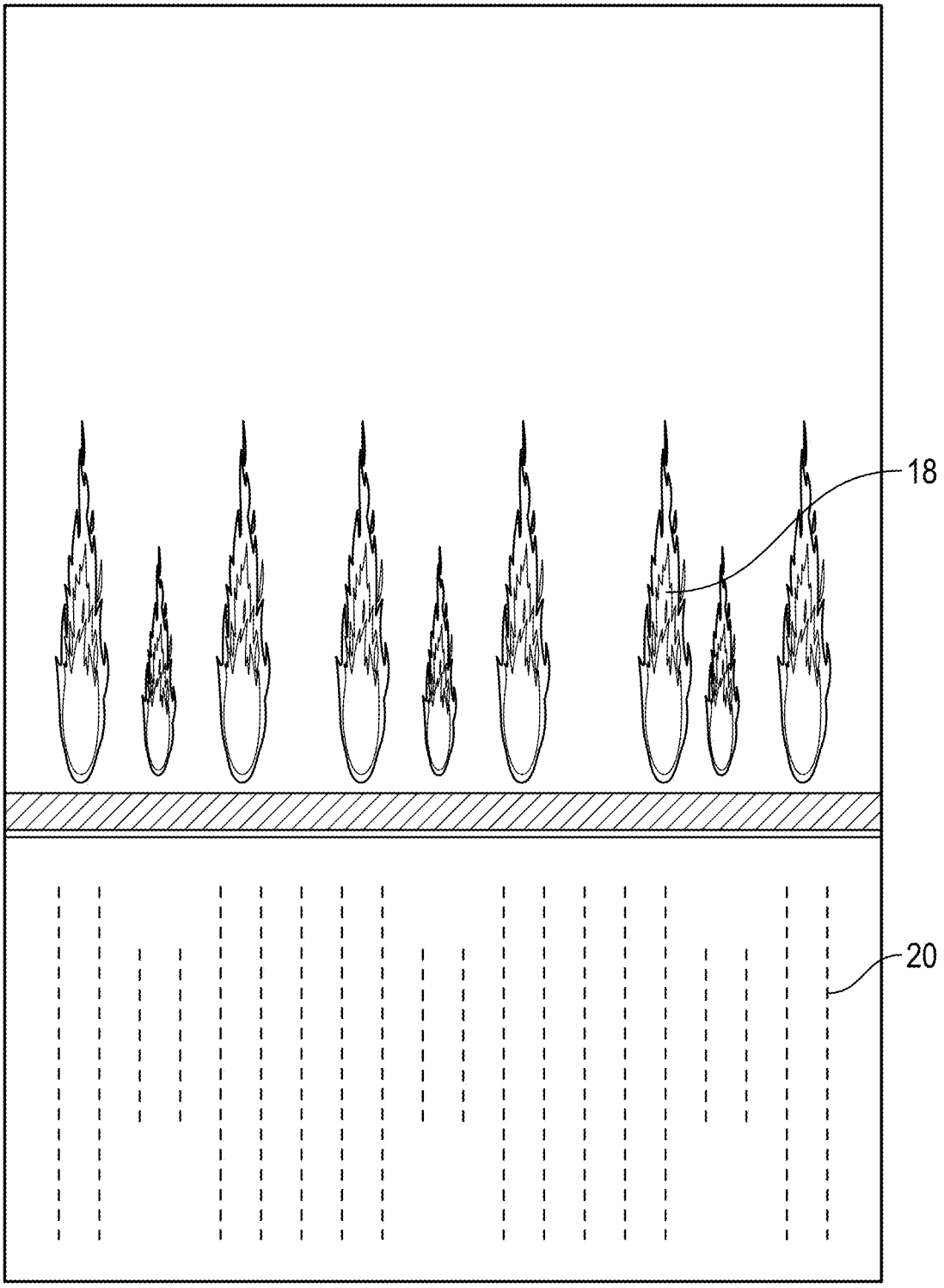
FIG. 7 illustrates a hybrid heating design according to embodiments herein.

Further, in some embodiments, the fuel firing and amount of electrical heating elements can vary along the length of the heater. As illustrated in FIG. 7, the burners and electrical heating elements are arranged along the length and the height of the heater. The burners may have different sizes and capacities at different locations. The electrical heating elements may have different heating patterns, i.e., uniform heat output or in a selected pattern to target different heat outputs at different locations. The selective different heat input by the burner and electrical heating elements may be used to improve the process stream temperature profiles, including the process stream film temperature and tube metal temperature, to achieve improved process performance, longer run length, longer heater service life and good control of process variations.

Figure 8:
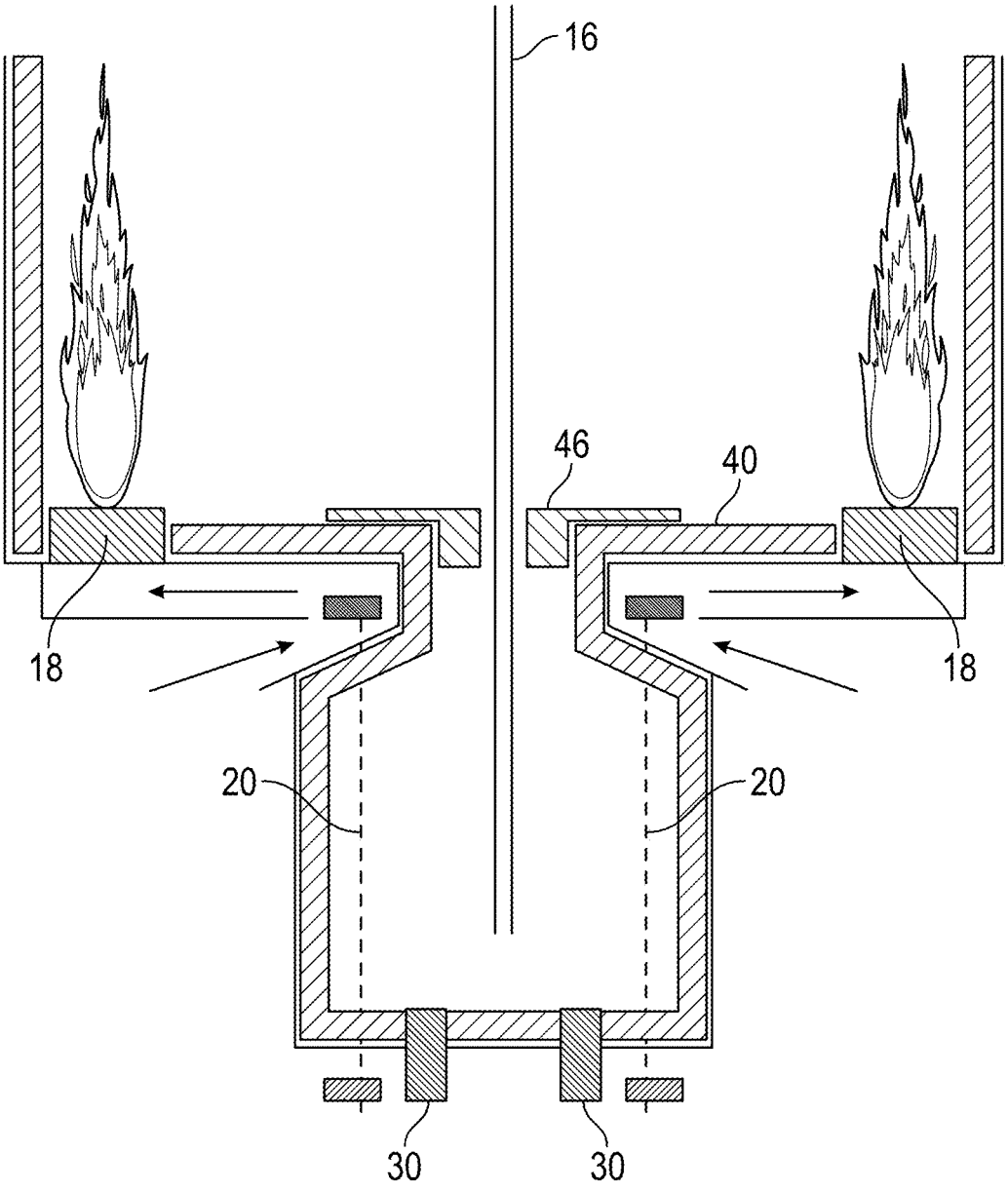
FIG. 8 illustrates a hybrid heating design according to embodiments herein.

In one or more embodiments, the fuel firing and the electrical heating may be separated by one or more partition plates. As illustrated in FIG. 8, partition plates 46 are disposed between one or more hearth burners 18 and one or more electrical heating elements 20. One or more partition plates may protect and minimize the possibility of flame impingement to the one or more electrical heating elements 20.

In some embodiments, it may be desired to allow purge gas to flow through the gaps between the partition plates 46 and the radiant coil 16 and/or the gaps between the partition plates 46 and the refractory material 40 of the exterior wall. The purge gas flowing through the gaps in the partition plates 46 between the electrical heating elements 20 and the fuel firing hearth burner 18 may reduce restriction in heat flux, prevent any pressure buildup in the electrical heating section, and promote upward flow of exhaust so as to avoid soot or combustion gas impingements, maintaining an environment favorable to the electrical heating element operation.

In one or more embodiments, the partition plates 46 may be composed of any high temperature material. In some embodiments, the partition plate 46 may be in the physical form of flat plates, bellowed plates, and fabric, in any combination thereof.

The hybrid heaters described herein can be operated with electric power while the burners are in off status, while the electric power is turned off and the burners are fired, or where both the electric and burners are operated at the same time. Further, embodiments herein including multiple burners or multiple electrical heating sections can be operated with less than a total amount of the burners fired, less than a total amount of the electrical heating sections powered, or both burners and heating elements operating at a reduced number. In various embodiments, the burners can be fired at the design capacity or reduced capacity. The burners can also be fired selectively, i.e., different burners are fired differently, or some burners are in off conditions. Further, the heating elements can all be on, or partially on, or powered differently, for optimum heat balance.

The electrical heating elements may be used, as described above, to supplement and provide additional heat to the back side of process coils. As some energy may still be re-radiated by the refractory material, the number, size, spacing and location of the electrical heating elements may be appropriately designed for a particular heater and process coil arrangement to provide the intended effect of enhanced heating using the hybrid heater.

Hybrid heaters according to embodiments herein may, as noted above, provide for heating of the process fluid via electrical heat, fuel-fired heat, or both. The amount of heat input via each source may depend upon operating conditions, where during upset, turndown, or maintenance conditions, 100% of heating may be provided via combustion, or 100% of the heating may be provided via electric. During normal operations, however, the total heat input will be provided by a combination of electrical heating elements and fuel fired burners. For such hybrid heating, the electrical heating elements of hybrid heaters herein are designed to provide 5% or more of the combined maximum energy output of the fuel fired burners and heating elements. For example, the electrical heating elements of hybrid heaters herein may provide 5% or more, 8% or more, 10% or more, 15% or more, 20% or more, 30% or more, 40% or more, or even 50% or more of the combined maximum energy output, and up to 15% or less, 20% or less, 25% or less, 30% or less, 40% or less, 50% or less, 60% or less, 70% or less, or 80% or less of the combined maximum energy output, where any lower limit may be combined with any mathematically compatible upper limit.

As described above, embodiments herein provide hybrid heaters, allowing for hybrid heating by fuel and electricity. Embodiments herein may also provide for operational flexibility for operating with fuel or electricity independently. Embodiments of the present disclosure may thus provide advantages in one or more of increased heater capacity, reduced heater surface area, reduced process fluid pressure drop, reduced CO2 emissions, process continuity during fuel or electricity upsets, among other advantages. Further, embodiments herein may provide adaptability to operate more effectively at turndown conditions.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. An apparatus for heating petroleum, petrochemical, chemical process fluids, and boiler feed water or steam generation with a combination, or individual operation, of electrical elements and fired burners comprising:

a radiant heating section and a flue gas stack for exhausting a combustion gas to the atmosphere;

one or more process coils disposed within the radiant heating section;

one or more fuel-fired burners disposed within the radiant heating section, the one or more fuel-fired burners configured for combusting a fuel and producing the combustion gas, wherein the one or more fuel-fired burners are arranged to provide a first radiant energy to an upper elevation of the one or more process coils;

one or more electrical heating elements disposed within the radiant heating section, the one or more electrical heating elements arranged to provide a second radiant energy to a lower elevation of the one or more process coils; and an internal baffle located at an elevation between the upper elevation and the lower elevation, the internal baffle arranged to provide shielding of the one or more electrical heating elements from flame and combustion gases from the one or more fuel-fired burners;

wherein the one or more electrical heating elements are configured to provide 5% or more of a combined maximum energy output of the one or more fuel-fired burners and the one or more electrical heating elements.

2. The apparatus of claim 1, wherein the one or more fuel-fired burners include one or more floor burners, one or more wall burners, or a combination of floor and wall burners.

3. The apparatus of claim 1, further comprising a refractory material disposed between the one or more electrical heating elements and an internal surface of an exterior wall of the radiant heating section.

4. The apparatus of claim 3, further comprising a refractory coating disposed between the one or more electrical heating elements and the refractory material.

5. The apparatus of claim 1, wherein the internal baffle is configured to provide an opening between the upper elevation and the lower elevation.

6. The apparatus of claim 1, wherein the internal baffle is configured to close the upper elevation from the lower elevation.

7. The apparatus of claim 1, wherein the one or more electrical hearting elements further comprise one or more electrical connections, wherein the one or more electrical connections are located on an exterior of the radiant heating section.

8. The apparatus of claim 7, further comprising an external baffle configured to direct a combustion air over at least one of the one or more electrical connections and provide the combustion air to the one or more fuel-fired burners.

9. The apparatus of claim 1, further comprising a second refractory material disposed on the internal baffle.

10. The apparatus of claim 1, wherein the one or more electrical heating elements are located between 12 and 18 inches from the one or more process coils.

11. The apparatus of claim 1, further comprising one or more purge gas inlets disposed in the lower elevation of the radiant heating section, the one or more purge gas inlets configured to maintain a working environment within the lower elevation.

12. A process for retrofitting a fuel-fired heater, having a radiant heating section, one or more process coils in the radiant heating section, and a flue gas stack, for heating petroleum, petrochemical, chemical process fluids, and boiler feed water or steam generation to include a combination of electrical heating elements and fuel-fired burners, the process comprising:

removing one or more fuel-fired burners disposed at a lower elevation in the radiant heating section;

retaining one or more fuel-fired burners disposed at an upper elevation in the radiant heating section;

disposing one or more layers of refractory material in the lower elevation in the radiant heating section;

disposing one or more electrical heating elements in the lower elevation in the radiant heating section proximate a surface of the one or more layers of refractory material, wherein the one or more electrical heating elements are disposed at a distance of 12 to 18 inches from the one or more process coils; and disposing an internal baffle between the upper elevation and the lower elevation, the internal baffle configured to provide shielding of the one or more electrical heating elements from flame and combustion gases from the one or more fuel-fired burners.

13. The process of claim 12, further comprising providing a refractory shielding material between the one or more electrical heating elements and the one or more layers of refractory material.

14. The process of claim 12, further comprising disposing one or more purge gas inlets in the lower elevation of the radiant heating section, the one or more purge gas inlets configured to maintain a working environment within the lower elevation.

15. A method of retrofitting a cracking heater comprising a radiant heating zone and a convective heating zone, wherein the radiant heating zone comprises a floor, floor burners disposed in the floor, a refractory wall including a first wall opposite a second wall, wall burners disposed along a height of the first wall and the second wall, and a radiant coil disposed within the radiant heating zone intermediate the first wall and the second wall, the method comprising:

installing an intermediate floor at an elevation below a wall burner;

installing a second refractory wall from the floor to the intermediate floor;

moving a floor burner from the floor to the intermediate floor;

installing one or more electrical heating elements along a height of the second refractory wall.

16. The method of claim 15, wherein the second refractory wall is closer to the radiant coil than the refractory wall.

17. The method of claim 15, wherein the intermediate floor and the second refractory define a bull nose above the one or more electrical heating elements, the bull nose separating a lower elevation of the radiant heating zone from an upper elevation of the radiant heating zone.

18. The method of claim 15, further comprising installing a purge air inlet proximate the floor.

* * * * *